US006901960B2

(12) United States Patent
Roberts et al.

(10) Patent No.: US 6,901,960 B2
(45) Date of Patent: Jun. 7, 2005

(54) DOUBLE DIAPHRAGM PUMP INCLUDING SPOOL VALVE AIR MOTOR

(75) Inventors: C. Oakley Roberts, Edon, OH (US); Lloyd I. Towne, Bryan, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 10/236,263

(22) Filed: Sep. 6, 2002

(65) Prior Publication Data

US 2004/0047748 A1 Mar. 11, 2004

(51) Int. Cl.[7] ..... F15B 13/042

(52) U.S. Cl. ..... 137/625.66; 92/170.1; 92/171.1; 417/395

(58) Field of Search ..... 137/625.66; 251/31, 251/368; 417/395; 92/170.1, 171.1

(56) References Cited

U.S. PATENT DOCUMENTS

| | | | | | |
|---|---|---|---|---|---|
| 2,381,544 | A | | 8/1945 | Jacobsen | |
| 2,952,218 | A | | 9/1960 | Steffes | |
| 3,385,174 | A | | 5/1968 | Crosland | |
| 3,604,822 | A | | 9/1971 | Saxe | |
| 3,643,700 | A | * | 2/1972 | Black | 137/625.68 |
| 4,337,797 | A | * | 7/1982 | Caruso | 137/625.48 |
| 4,403,539 | A | | 9/1983 | Motoki et al. | |
| 4,448,063 | A | | 5/1984 | Mudge et al. | |
| 4,576,200 | A | * | 3/1986 | Janecke et al. | 137/625.13 |
| 4,740,202 | A | | 4/1988 | Stacey et al. | |
| 4,795,448 | A | | 1/1989 | Stacey et al. | |
| 4,830,586 | A | | 5/1989 | Herter et al. | |
| 4,872,816 | A | | 10/1989 | Fetcko | |
| 4,936,753 | A | | 6/1990 | Kozumplik, Jr. et al. | |
| 4,978,283 | A | | 12/1990 | Vonalt | |
| 5,108,270 | A | | 4/1992 | Kozumplik, Jr. | |
| 5,129,427 | A | | 7/1992 | White et al. | |
| 5,172,793 | A | * | 12/1992 | Temple et al. | 92/170.1 |
| 5,222,425 | A | * | 6/1993 | Davies | 91/273 |
| 5,269,664 | A | | 12/1993 | Buse | |
| D347,639 | S | | 6/1994 | Fast et al. | |
| 5,334,003 | A | | 8/1994 | Gardner et al. | |
| 5,345,965 | A | | 9/1994 | Blume | |
| 5,366,351 | A | | 11/1994 | Nolte | |
| 5,391,060 | A | | 2/1995 | Kozumplik, Jr. et al. | |
| 5,409,040 | A | * | 4/1995 | Tomlin | 137/625.66 |
| 5,450,987 | A | | 9/1995 | Nolte | |
| D370,488 | S | | 6/1996 | Kozumplik, Jr. et al. | |
| 5,551,847 | A | | 9/1996 | Gardner et al. | |
| 5,559,310 | A | | 9/1996 | Hoover et al. | |
| 5,584,666 | A | | 12/1996 | Kozumplik, Jr. et al. | |
| 5,634,391 | A | | 6/1997 | Eady | |
| 5,647,737 | A | | 7/1997 | Gardner et al. | |
| 5,649,809 | A | | 7/1997 | Stapelfeldt | |
| 5,649,813 | A | | 7/1997 | Able et al. | |

(Continued)

OTHER PUBLICATIONS

The apparatus disclosed in the attached drawings was publicly disclosed prior to Sep. 6, 2001. Ingersoll–Rand Model 2o192 3–way poppet valve.

*Primary Examiner*—Michael Koczo
(74) *Attorney, Agent, or Firm*—Michael Best & Friedrich LLP

(57) ABSTRACT

A double diaphragm pump including a pump housing, first and second pump diaphragms, an inlet manifold, an outlet manifold, and an air motor. The air motor includes a spool valve having a valve housing, an insert surrounded by the valve housing, and a spool. The valve housing and the insert cooperate to at least partially define a valve chamber, and the spool is slidably positioned within the valve chamber. The spool includes a seal engaging an inner surface of the insert and delimiting the valve chamber into valve subchambers. Movement of the spool within the valve chamber selectively communicates pressurized fluid to one of the diaphragms to move the associated diaphragm, thereby pumping fluid through the pump.

32 Claims, 5 Drawing Sheets

U.S. PATENT DOCUMENTS

| | | | | |
|---|---|---|---|---|
| 5,664,940 | A | | 9/1997 | Du |
| 5,687,633 | A | | 11/1997 | Eady |
| D388,796 | S | | 1/1998 | Conti et al. |
| D388,797 | S | | 1/1998 | Conti et al. |
| 5,711,658 | A | | 1/1998 | Conti et al. |
| 5,733,253 | A | | 3/1998 | Headley et al. |
| 5,737,920 | A | | 4/1998 | Able |
| 5,848,615 | A | | 12/1998 | Conti et al. |
| 5,848,878 | A | | 12/1998 | Conti et al. |
| 5,885,239 | A | | 3/1999 | Headley et al. |
| 5,893,490 | A | | 4/1999 | Gnyp |
| 5,894,784 | A | | 4/1999 | Bobbitt, III et al. |
| 5,905,212 | A | | 5/1999 | Moses et al. |
| 5,951,259 | A | | 9/1999 | Gardner et al. |
| 5,951,267 | A | | 9/1999 | Piercey et al. |
| 6,019,742 | A | | 2/2000 | Headley et al. |
| 6,039,711 | A | | 3/2000 | Headley et al. |
| 6,065,389 | A | | 5/2000 | Riedlinger |
| 6,074,335 | A | | 6/2000 | Headley et al. |
| 6,099,491 | A | | 8/2000 | Headley et al. |
| 6,109,300 | A | * | 8/2000 | Najmolhoda ..... 137/596.16 |
| 6,113,359 | A | | 9/2000 | Watts et al. |
| 6,142,749 | A | | 11/2000 | Jack et al. |
| 6,145,430 | A | | 11/2000 | Able et al. |
| 6,168,387 | B1 | | 1/2001 | Able et al. |
| 6,190,136 | B1 | | 2/2001 | Meloche et al. |
| 6,230,609 | B1 | | 5/2001 | Bender et al. |
| 6,257,845 | B1 | | 7/2001 | Jack et al. |
| 6,280,149 | B1 | | 8/2001 | Able et al. |
| 6,299,173 | B1 | | 10/2001 | Lai |
| 6,299,413 | B1 | | 10/2001 | Stahlman et al. |
| 6,363,894 | B1 | | 4/2002 | Barkman |
| 6,558,141 | B2 | | 5/2003 | Vonalt et al. |
| 6,602,179 | B1 | | 8/2003 | Headley et al. |
| 6,644,941 | B1 | | 11/2003 | Able et al. |
| D484,145 | S | | 12/2003 | Roberts et al. |
| 6,722,256 | B2 | | 4/2004 | Roberts et al. |
| 6,722,259 | B2 | | 4/2004 | Hisanaga et al. |
| 2001/0051569 | A1 | | 12/2001 | Headley |
| 2003/0110939 | A1 | | 6/2003 | Able et al. |
| 2003/0125182 | A1 | | 7/2003 | Headley et al. |
| 2003/0198560 | A1 | | 10/2003 | Able et al. |
| 2004/0018053 | A1 | | 1/2004 | Starry, Jr. et al. |
| 2004/0047748 | A1 | | 3/2004 | Roberts et al. |
| 2004/0047749 | A1 | | 3/2004 | Roberts et al. |
| 2004/0050242 | A1 | | 3/2004 | Roberts et al. |
| 2004/0069140 | A1 | | 4/2004 | Able et al. |

* cited by examiner

DOUBLE DIAPHRAGM PUMP INCLUDING SPOOL VALVE AIR MOTOR

FIELD OF THE INVENTION

The present invention relates to air operated double diaphragm pumps, and more particularly to double diaphragm pumps incorporating a spool valve as an air motor.

BACKGROUND OF THE INVENTION

Air operated double diaphragm pumps are known for pumping a wide variety of substances. In some applications, double diaphragm pumps are utilized to pump caustic chemicals, in other applications, comestible substances such as flowable foods and beverages can be pumped. In such applications, the pumps are often constructed primarily of materials that resist corrosion and that are chemically compatibable with the substances being pumped. In this regard, polymeric materials are often used for various pump components.

To operate the double diaphragm pump, air motors are having flow control spool valves are often provided to regulate the flow of compressed air through the pump and oscillatingly drive the pump diaphragms. The spool valves generally include a valve housing that defines a valve chamber, and a spool that is received by the valve chamber. The spool includes a plurality of seals that delimit the chamber into two or more subchambers. The spool is slidably movable within the valve chamber such that the seals, and therefore the subchambers, move within the chamber to regulate the flow of pressurized air to the pump diaphragms.

SUMMARY OF THE INVENTION

The present invention provides a spool valve including a valve housing, a first insert surrounded by the housing, and a second insert surrounded by the housing. The inserts each include an inner surface that cooperates with the valve housing to at least partially define a valve chamber. A spool is slidably positioned within the valve chamber and includes a first seal engaging the inner surface of the first insert, and a second seal engaging the inner surface of the second insert. The first and second seals delimit the valve chamber into valve subchambers.

The present invention also provides a double diaphragm pump that includes a pump housing, first and second pump diaphragms, an inlet manifold, an outlet manifold, and an air motor. The pump housing defines first and second pumping chambers, and the diaphragms are housed in respective ones of the pumping chambers. Each diaphragm divides its respective pumping chamber into a first subchamber and a second subchamber, and the diaphragms are coupled to one another other for reciprocating movement within the pumping chambers.

The inlet manifold and the outlet manifold are coupled to the pump housing and communicate with at least one of the first subchambers. The air motor is also coupled to the pump housing and fluidly communicates with the second subchambers to reciprocatingly drive the diaphragms. The air motor includes a spool valve having a valve housing, an insert surrounded by the valve housing, and a spool. The valve housing and the insert cooperate to at least partially define a valve chamber, and the spool is slidably positioned within the valve chamber. The spool includes a seal engaging an inner surface of the insert and delimiting the valve chamber into valve subchambers. Movement of the spool within the valve chamber selectively communicates pressurized fluid to one of the second subchambers to move the associated diaphragm, thereby pumping fluid through the pump.

The present invention further provides a method for making an air motor for a double diaphragm pump. A tubular insert is formed that has a generally cylindrical inner surface, and the insert is positioned within a cavity of a forming die. A polymer is molded around the insert to form a valve body. The valve body cooperates with the inner surface of the tubular insert to define at least a portion of a valve chamber. A valve spool including a seal is inserted into the valve chamber, and the seal is aligned for engagement with the inner surface of the insert such that the valve chamber is delimited into valve subchambers.

Other features of the invention will become apparent to those skilled in the art upon review of the following detailed description and drawings.

Figure 1:
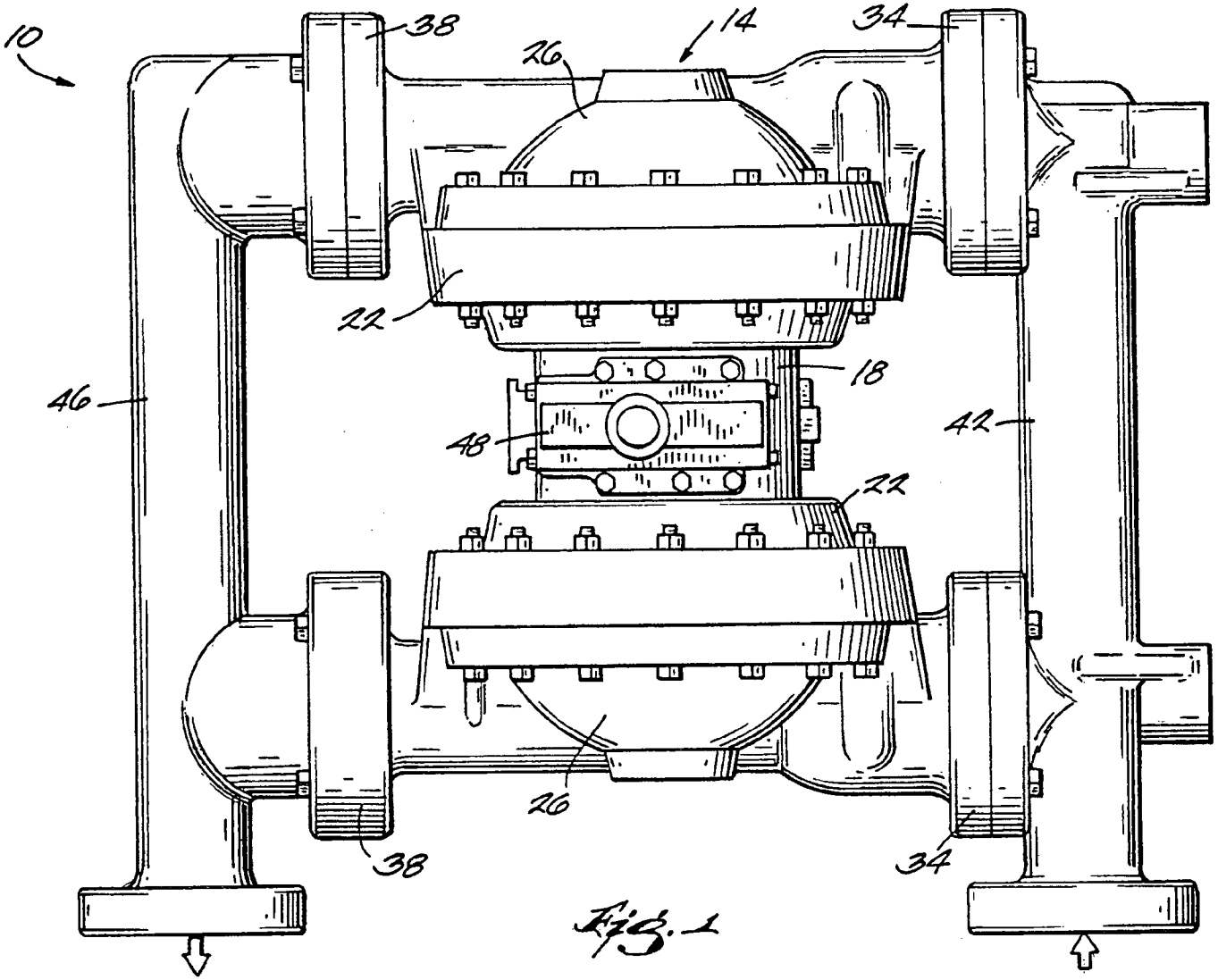
FIG. 1 is a front view of an air operated double diaphragm pump assembly embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

Figure 2:
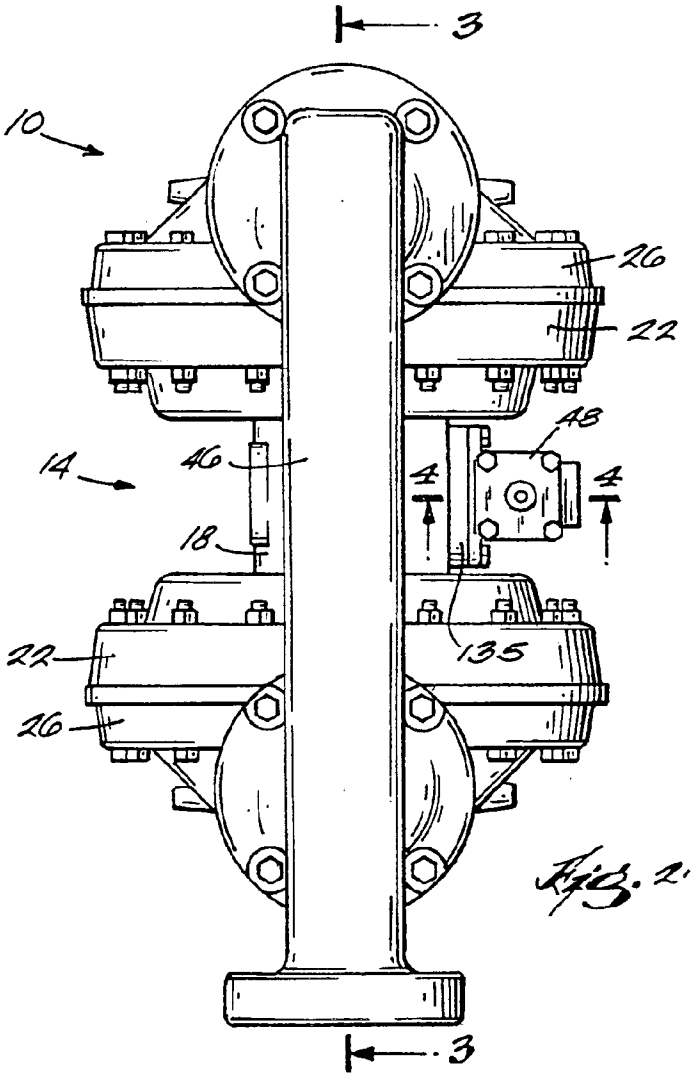
FIG. 2 is an end view of the air operated double diaphragm pump assembly of FIG. 1.
Figure 3:
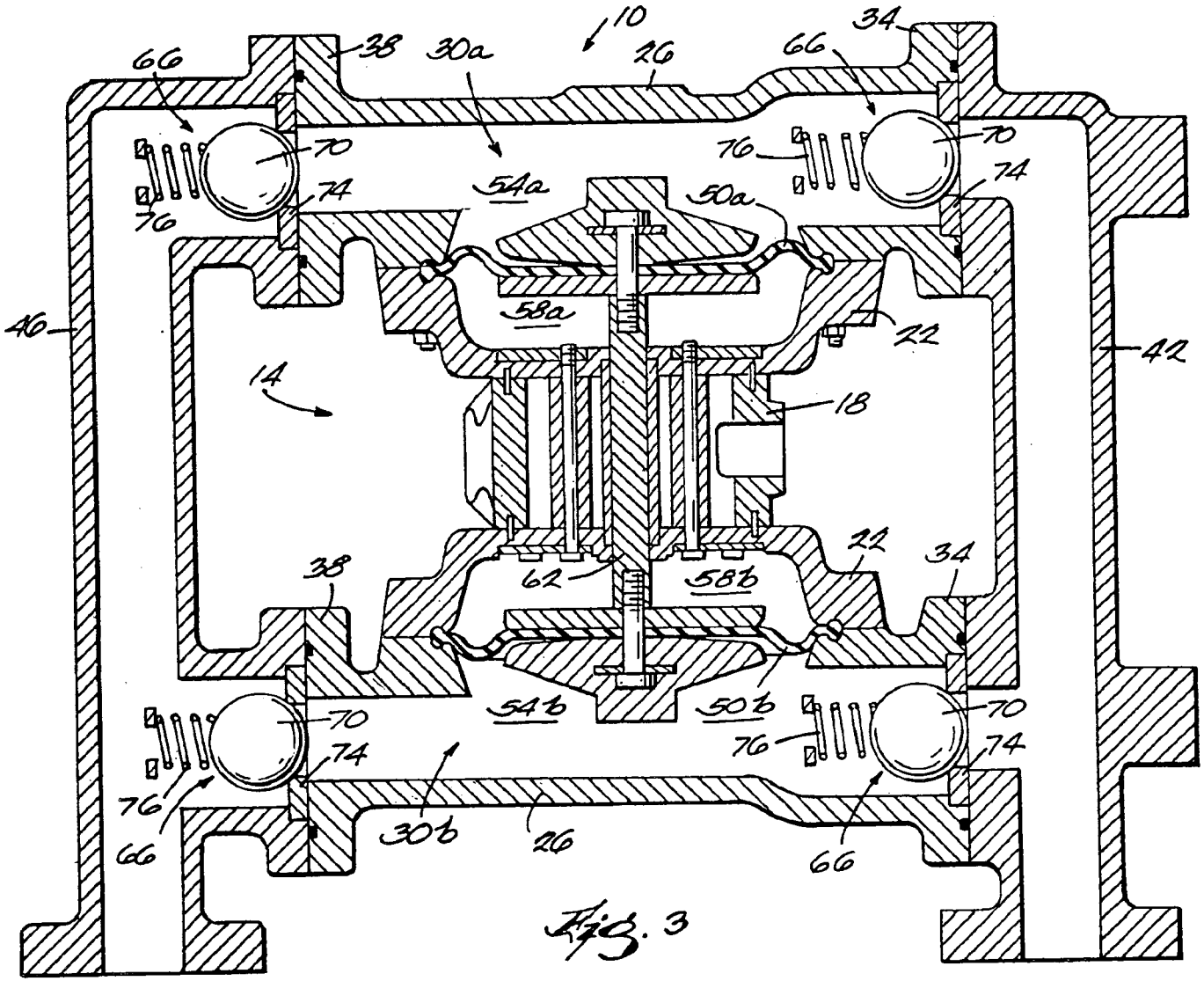
FIG. 3 is a section view taken along line 3—3 of FIG. 2.

FIGS. 1–3 illustrate an air operated double diaphragm pump 10 embodying the invention. The pump 10 includes a main pump housing assembly 14 that includes a centerbody 18, a pair of air caps 22 coupled to opposite sides of the centerbody 18, and a pair of fluid caps 26 coupled to the air caps 22 and cooperating therewith to define a pair of pumping chambers 30*a*, 30*b* (see FIG. 3). Each fluid cap 26 includes an inlet flange 34 and an outlet flange 38. The inlet flanges 34 are coupleable, independently or in combination, to an inlet manifold 42. Similarly, the outlet flanges 38 are coupleable, independently or in combination, to an outlet manifold 46. The flanges 34, 38 and manifolds 42, 46 can be configured such that the pumping chambers 30*a*, 30*b* operate in parallel to pump a single fluid (as illustrated), pump two fluids independently of each other, or mix two pumped fluids together in the outlet manifold 46. An air motor 48 in the form of a spool valve assembly is secured to the centerbody 18 and is configured to drive the pump 10, as will be described further below.

With reference to FIG. 3, flexible diaphragms 50*a*, 50*b* are secured within respective pumping chambers 30*a*, 30*b* between the associated air caps 22 and fluid caps 26. The diaphragm 50*a* delimits the pumping chamber 30*a* into a first subchamber 54*a* and a second subchamber 58*a*. Similarly, the diaphragm 50*b* delimits the pumping chamber 30*b* into a first subchamber 54*b* and a second subchamber 58*b*. The first subchambers 54*a*, 54*b* communicate with the inlet manifold 42 and the outlet manifold 46, and the second subchambers 58*a*, 58*b* communicate with the air motor 48 via the centerbody 18. The diaphragms 50*a*, 50*b* are coupled to each other by a diaphragm rod 62 that is slidingly coupled to the centerbody 18. During pump operation, the diaphragm rod 62 reciprocates within the centerbody 18 and the diaphragms 50*a*, 50*b* deflect within the pumping chambers 30*a*, 30*b* to increase and decrease the volume of the first subchambers 54*a*, 54*b*, and the second subchambers 58*a*, 58*b*.

To regulate fluid flow through the pump 10, the outlet manifold 46 and the inlet flanges 34 include check valves 66. The illustrated check valves 66 are ball check valves and include a valve ball 70, a valve seat 74, and a valve spring 76. The valve springs 76 urge the valve balls 70 into sealing engagement with the valve seat 74. In some embodiments, the valve springs 76 can be eliminated and the valve balls 70 are urged into engagement with the valve seats 74 due to pressure pulses that are inherent in pump operation. The check valves 66 operate in a known manner to allow fluid to flow substantially in a single direction from the inlet manifold 42 toward the outlet manifold 46. Other types of check valves, such as flapper valves can be used as well. In some embodiments, the check valves 66 can be formed integrally with the inlet and outlet manifolds, 42, 46, or integrally with the fluid caps 26. Other embodiments can incorporate check valves 66 that are completely separate assemblies that are positioned and secured between the manifolds 42, 46 and the fluid caps 26 upon assembly of the pump 10.

Figure 4:
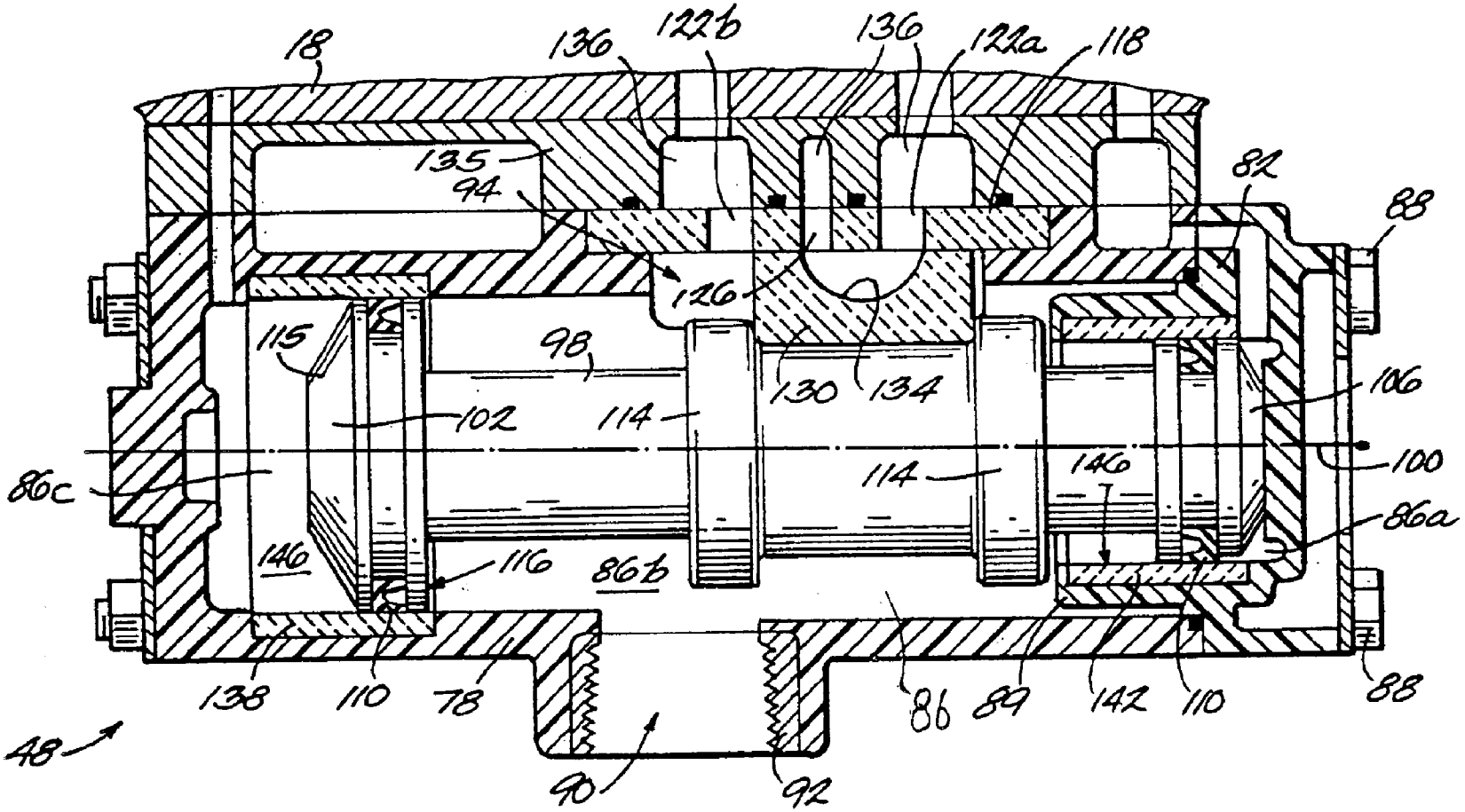
FIG. 4 is a section view taken along line 4—4 of FIG. 2.

Referring now to FIG. 4, the spool valve air motor 48 includes a valve housing comprising a valve block 78 and a valve cap 82 that are coupled to one another and cooperate to at least partially define a generally cylindrical valve chamber 86. The valve cap 82 includes a portion 89 that is received by the valve block 78, and the valve cap 82 is secured to the valve block 78 by fasteners 88, although other techniques for securing the valve cap 82 to the valve block 78 such as clamps, adhesives and the like can be used as well. The valve block 78 defines an inlet opening 90 in a central portion thereof that communicates with the valve chamber 86. The inlet opening 90 can include a threaded insert 92 such that a source of pressurized fluid, such as air, can be coupled to the inlet opening 90, thereby increasing the pressure within the valve chamber 86. The inlet opening 90 can also be coupled to the pressurized air source using other known connections, such as air nipples and the like. The valve block 78 also defines an outlet opening 94 that provides fluid communication between the valve chamber 86 and the centerbody 18, as well as other pump components.

A valve spool 98 is received by the valve chamber 86 and is slidingly movable therein for reciprocation along a valve axis 100. The valve spool 98 is movable between a first position (illustrated in FIG. 4) where the valve spool 98 is shifted toward the valve cap 82, and a second position (not shown), where the valve spool 98 is shifted away from the valve cap 82. The illustrated valve spool 98 includes a large end 102 and a small end 106, and a generally resilient annular seal 110 surrounds each end 102, 106. The seals 110 engage the valve block 78 and the valve cap 82 to delimit the valve chamber 86 into valve subchambers 86*a*, 86*b*, 86*c*. The valve spool 98 also includes two radially extending collars 114 positioned between the ends 102, 106. During operation of the illustrated pump 10, subchamber 86*a* is substantially always vented to the atmosphere, subchamber 86*b* is substantially always at an elevated pressure, and subchamber 86*c* alternates between the elevated pressure and atmospheric pressure. The changes in pressure within the subchamber 86*c* reciprocatingly drive the valve spool 98 between the first and second positions. Specifically, an end surface 115 of the valve spool 98 faces the subchamber 86*c*, and an annular surface 116 of the valve spool 98 faces the subchamber 86*b*. The surface area of the annular surface 116 is less than the surface area of the end surface 115 such that, when an equal pressure is applied to both surfaces (as is the case when the subchamber 86*c* is at the elevated pressure), the total force acting upon the end surface 115 is greater than the total force acting on the annular surface 116. The valve spool 98 is therefore urged toward the first position (illustrated in FIG. 4), which is referred to as the "piloted position". When the subchamber 86*c* is vented to the atmosphere, the total force on the end surface 115 is reduced, and the pressure applied to the annular surface 116 moves the valve spool 98 toward the second position.

Positioned in the outlet opening 94 of the valve block 78 is a valve plate 118. The valve plate 118 defines a pair of fill orifices 122*a*, 122*b*, and an exhaust orifice 126 between the fill orifices 122*a*, 122*b*. The valve plate 118 substantially overlies the outlet opening 94 such that air flowing out of the valve chamber 86*b* flows through at least one of the fill orifices 122*a*, 122*b*. A valve insert 130 slidingly engages the valve plate 118 and is carried between the radially extending collars 114 of the valve spool 98 for reciprocating movement therewith. The valve insert 130 includes a concave recess 134 that is configured to provide fluid communication between one of the fill orifices 122*a*, 122*b* and the exhaust orifice 126, depending upon the position of the valve spool 98 in the valve chamber 86. In the illustrated embodiment, the valve insert 130 and the valve plate 118 are fabricated from ceramic materials, however other types of materials can be used as well. An adapter plate 135 is positioned between the spool valve 48 and the centerbody 18 and provides communication channels 136 that afford communication between the fill and exhaust orifices 122*a*, 122*b*, 126, and the centerbody 18. Differently configured adapter plates 135 can be provided such that the spool valve air motor 48 can be used with a variety of pump centerbodies 18. The adapter plate 135 and the centerbody 18 cooperate to afford communication between the fill orifices 122*a*, 122*b* and the second subchambers 58*a*, 58*b* respectively.

With reference to FIGS. 3 and 4, the fill orifice 122*a* is open to the valve chamber 86*b*, and the fill orifice 122*b* is in communication with the exhaust orifice 126 by way of the concave recess 134. As such, pressurized air flows from the valve chamber 86*b*, through the fill orifice 122*a*, and into the second subchamber 58*a*. The increased pressure in the second subchamber 58*a* causes the diaphragm 50*a* to deflect such that the volume of the second subchamber 58*a* increases, and the volume of the first subchamber 54*a* decreases. As a result of the volume changes, pumped fluid is expelled from the first subchamber 54*a* into the outlet manifold 46. Simultaneously, due to the connection provided by the diaphragm rod 62, the opposite diaphragm 50*b* deflects such that the first subchamber 54*b* increases in volume and the second subchamber 58*b* decreases in volume. The increase in volume of the first subchamber 54*b* draws fluid past the associated check valve 66 and into the first subchamber 54*b* from the inlet manifold 42. As the second subchamber 58*b* decreases in volume, the air therein is vented to the atmosphere. In some embodiments, the air in the second subchamber 58*b* is vented to the atmosphere via the fill orifice 122*b*, the concave recess 134, and the exhaust orifice 126. In other embodiments, air in the second subchamber 58*b* is vented directly to the atmosphere via a dump valve (not shown) that is in fluid communication with the second subchamber 58*b* and the atmosphere.

When the diaphragms 50*a*, 50*b* and the diaphragm rod 62 reach the end of their travel, a pilot valve (not shown) is operated and the pressure within the valve chamber 86*c* is changed such that the valve spool 98 moves within the valve chamber 86, thereby moving the valve insert 130. Movement of the valve insert changes the flow configuration of the fill orifices 122*a*, 122*b* such that the fill orifice 122*b* is in communication with the pressurized valve chamber 86*b*, and the fill orifice 122*a* is in communication with the exhaust orifice 126 by way of the concave recess 134. As a result, the diaphragms 50*a*, 50*b* move in an opposite direction, further changing the volumes of the first subchambers 54*a*, 54*b* and the second subchambers 58*a*, 58*b* to pump additional fluid from the inlet manifold 42 toward the outlet manifold 46. The valve spool 98 and the diaphragms 50*a*, 50*b* continue moving in a reciprocating manner throughout pump operation.

To facilitate sealing within the valve chamber 86, the valve block 78 is provided with a first sealing insert 138, and the valve cap 82 is provided with a second sealing insert 142. The valve block 78 at least partially surrounds the first insert 138 and cooperates therewith to define a first portion of the valve chamber 86. Similarly, the valve block 78 at least partially surrounds the second insert 142 and cooperates therewith to define a second portion of the valve chamber 86. When the valve cap 82 is secured to the valve block 78, the chamber is substantially completely defined. Each insert 138, 142 is positioned in the valve chamber 86 to surround one of the ends 102, 106 of the valve spool 98. Each insert 138, 142 includes a generally cylindrical inner surface 146 that sealingly engages the associated annular seal 110. The cylindrical inner surfaces 146 are preferably fabricated to provide sealing surfaces having a reduced surface roughness with respect to the surfaces of the valve block 78 and valve cap 82. For example, in the illustrated embodiment, the valve block 78 and the valve cap 82 can be fabricated of a reinforced polymer including glass fiber fillers. Glass filled polymers of this type are utilized in diaphragm pump applications for various reasons, some of which may include chemical compatibility, corrosion resistance, and strength. One drawback to the use of glass filled polymers however is an increased surface abrasiveness due to the reinforcing glass fibers. This surface abrasiveness can lead to accelerated seal wear and leaking. By providing the sealing inserts 138, 142, the surfaces upon which the seals 110 slide can be manufactured to have improved surface characteristics, thereby extending the life of the seals 110 and reducing the likelihood of leakage between the valve chambers 86*a*, 86*b*, 86*c*. In addition, the inserts 138, 142 can be fabricated in such a way that dimensional stability (e.g. the roundness and diameter of the cylindrical inner surfaces 146) is improved when compared to traditional injection molding techniques.

In some embodiments, including the embodiment illustrated in FIG. 4, the inserts 138, 142 can be formed from a generally tubular fiber-matrix composite material. One method for forming the inserts 138, 142 includes winding glass fibers around a mandrel, binding the fibers together with an epoxy matrix, and cutting the resulting section of composite tubing to appropriate lengths. Once the individual inserts 138, 142 are formed, the inserts can be positioned within injection molding dies and the valve block 78 and the valve cap 82 can be injection molded around the inserts 138, 142. It should be appreciated of course that other materials, such as metals, other composites, and polymers can be used in the fabrication of the inserts 138, 142. The valve block 78 and the valve cap 82 can be formed using other materials and manufacturing techniques as well, and the inserts 138, 142 can be inserted within the valve block and the valve cap 82 by other methods, such as press fitting, for example.

During pump operation, the seals 110 engage the inner surfaces 146 of the inserts 138, 142. The length and positioning of the inserts 138, 142 is such that the seals 110 and the inserts 138, 142 are in substantially continues sealing contact throughout movement of the valve spool 98 between the first and second positions.

Figure 5:
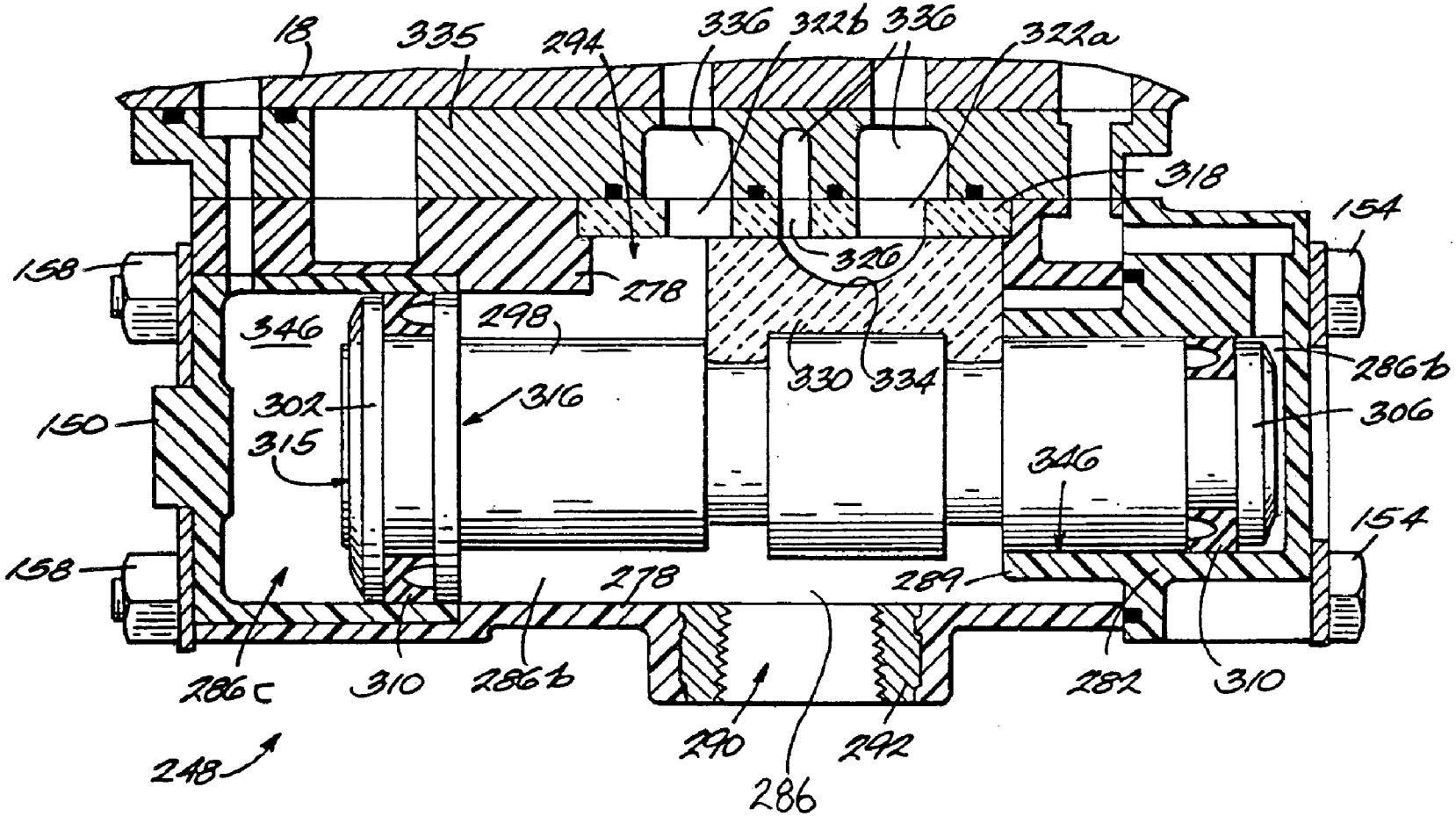
FIG. 5 is a section view similar to FIG. 4 illustrating an alternative embodiment of the invention.

FIG. 5 illustrates an alternative embodiment of the invention. Elements of the air motor illustrated in FIG. 5 have been given the same reference numerals as the corresponding elements from FIG. 4, increased by two hundred. The air motor 248 includes a valve block 278, and a valve cap 282. The valve block 278 is generally tubular, and the valve cap 282 is secured to and overlies one end of the valve block 278, and cooperates therewith to partially define the valve chamber 286. The opposite end of the valve block 278 includes an opening that receives a secondary valve cap 150. The secondary valve cap 150 overlies the opening and closes the valve chamber 286. The secondary valve cap 150 and the valve cap 282 are secured to the valve block 278 using elongated fasteners 154 and nuts 158, however other fastening methods are possible as well.

The valve chamber 286 receives the valve spool 298 and the annular seals 310 sealingly and slidingly engage the inner surfaces 346 of the valve cap 282 and the secondary valve cap 150. The valve insert 330 and the valve plate 318 operate in substantially the same manner as the valve insert 130 and valve plate 118 of FIG. 4. The valve cap 282 and the secondary valve cap 150 are preferably fabricated from a material having improved surface characteristics with respect to the fabrication material of the valve block 278. For example, the valve block 278 (like the valve block 78) can be fabricated using a glass filled polymer. To reduce seal wear and improve pump life, the valve cap 282 and the secondary valve cap 150 can be fabricated using a non-filled polymer, or from other materials such as metals, or composites. By utilizing the above-described construction, the valve block 278 is provided with suitable strength and stiffness to withstand the internal pressure forces developed during pump operations, while the valve cap 282 and secondary valve cap 150 improve the surface characteristics of the sealing surfaces to reduce seal wear.

Various features of the invention are set forth in the following claims.

What is claimed is:

1. A spool valve comprising:

a valve housing formed of a reinforced polymer and having an inner surface, the inner surface having a first surface roughness and at least partially defining a generally cylindrical valve chamber;

a first insert formed of a non-reinforced polymer and including an inner surface at least partially defining the valve chamber;

a second insert formed of a non-reinforced polymer and including an inner surface at least partially defining the valve chamber, the inner surface of the first insert and the inner surface of the second insert having a second surface roughness, the second surface roughness being less than the first surface roughness, the housing being molded around the first insert and the second insert; and a spool slidably positioned within the valve chamber and including a first seal engaging the inner surface of the first insert, and a second seal engaging the inner surface of the second insert, the first and second seals delimiting the valve chamber into valve subchambers.

2. The spool valve of claim 1, wherein the valve housing defines a fluid inlet opening communicating with at least one of the valve subchambers.

3. The spool valve of claim 1, wherein the valve housing defines a fluid outlet opening communicating with at least one of the valve subchambers.

4. The spool valve of claim 3, further comprising a valve plate overlying the outlet opening and defining a plurality of orifices, and a valve insert slidably engaging the valve plate and carried by the spool to selectively afford fluid communication between at least one of the valve subchambers and at least one of the orifices in response to sliding movement of the spool.

5. The spool valve of claim 1, wherein the spool is movable between first and second positions, and wherein the first and second seals substantially continuously engage the inner surfaces of the first and second inserts respectively during movement of the spool between the first and second positions.

6. The spool valve of claim 1, wherein the housing is injection molded around the first and second inserts and completely surrounds the inserts.

7. The spool valve of claim 1, wherein the valve housing includes a valve block surrounding the first insert and cooperating therewith to define a first portion of the valve chamber, and a valve cap surrounding the second insert and cooperating therewith to define a second portion of the valve chamber, and wherein the valve cap is securable to the valve block to define the valve chamber.

8. The spool valve of claim 1, wherein the housing is generally tubular, and wherein the inserts are received by open ends of the housing to close the valve chamber.

9. The spool valve of claim 1, wherein the reinforced polymer includes glass fibers.

10. The spool valve of claim 1, wherein the spool includes an outer surface having a third surface roughness, the third surface roughness being greater than the second surface roughness.

11. A spool valve comprising:

a valve housing formed of a polymer and at least partially defining a generally cylindrical valve chamber;

a first insert formed of a polymer and including an inner surface at least partially defining the valve chamber;

a second insert formed of a polymer and including an inner surface at least partially defining the valve chamber, the housing being molded around and sealingly engaging the first insert and the second insert; and a spool slidably positioned within the valve chamber and including a first seal engaging the inner surface of the first insert, and a second seal engaging the inner surface of the second insert, the first and second seals delimiting the valve chamber into valve subchambers.

12. The spool valve of claim 11, wherein the valve housing defines a fluid inlet opening communicating with at least one of the valve subchambers.

13. The spool valve of claim 11, wherein the valve housing defines a fluid outlet opening communicating with at least one of the valve subchambers.

14. The spool valve of claim 13, further comprising a valve plate overlying the outlet opening and defining a plurality of orifices, and a valve insert slidably engaging the valve plate and carried by the spool to selectively afford fluid communication between at least one of the valve subchambers and at least one of the orifices in response to sliding movement of the spool.

15. The spool valve of claim 11, wherein the spool is movable between first and second positions, and wherein the first and second seals substantially continuously engage the inner surfaces of the first and second inserts respectively during movement of the spool between the first and second positions.

16. The spool valve of claim 11, wherein the housing is injection molded around the first and second inserts.

17. The spool valve of claim 11, wherein the valve housing includes a valve block surrounding the first insert and cooperating therewith to define a first portion of the valve chamber, and a valve cap surrounding the second insert and cooperating therewith to define a second portion of the valve chamber, and wherein the valve cap is securable to the valve block to define the valve chamber.

18. The spool valve of claim 11, wherein the housing is generally tubular, and wherein the inserts are received by open ends of the housing to close the valve chamber.

19. The spool valve of claim 11, wherein the polymer of the housing is reinforced with glass fibers.

20. The spool valve of claim 11, wherein the inserts are formed of a fiber-matrix composite material.

21. The spool valve of claim 20, wherein the fibers of the fiber matrix material are bound together with an epoxy material.

22. The spool valve of claim 11, wherein the inserts are formed from wound glass fibers.

23. The spool valve of claim 11, wherein the housing has an inner surface having a first surface roughness, and wherein the inner surface of the first insert and the inner surface of the second insert have a second surface roughness, the second surface roughness being less than the first surface roughness.

24. The spool valve of claim 23, the spool includes an outer surface having a third surface roughness, the third surface roughness being greater than the second surface roughness.

25. A spool valve comprising:

a valve housing formed of a reinforced polymer and having an inner surface, the inner surface having a first surface roughness and at least partially defining a generally cylindrical valve chamber;

an insert formed of a non-reinforced polymer and including an inner surface at least partially defining the valve chamber, the inner surface of the insert having a second surface roughness, the second surface roughness being less than the first surface roughness, the housing being molded around the insert; and a spool slidably positioned within the valve chamber and including a seal engaging the inner surface of the insert, the seal delimiting the valve chamber into valve subchambers.

26. The spool valve of claim 25, wherein the valve housing defines a fluid inlet opening communicating with at least one of the valve subchambers.

27. The spool valve of claim 25, wherein the valve housing defines a fluid outlet opening communicating with at least one of the valve subchambers.

28. The spool valve of claim 27, further comprising a valve plate overlying the outlet opening and defining a plurality of orifices, and a valve insert slidably engaging the valve plate and carried by the spool to selectively afford fluid communication between at least one of the valve subchambers and at least one of the orifices in response to sliding movement of the spool.

29. The spool valve of claim 25, wherein the spool is movable between first and second positions, and wherein the seal substantially continuously engages the inner surface of the insert during movement of the spool between the first and second positions.

30. The spool valve of claim 25, wherein the housing is injection molded around the insert.

31. The spool valve of claim 25, wherein the reinforced polymer includes glass fibers.

32. The spool valve of claim 25, wherein the spool includes an outer surface having a third surface roughness, the third surface roughness being greater than the second surface roughness.

* * * * *